US005269716A

United States Patent [19]

Viola

[11] Patent Number: 5,269,716

[45] Date of Patent: Dec. 14, 1993

[54] FLYING TOY WITH RADIAL AIRFOILS

[76] Inventor: Charles Viola, 73 Earle Ave., Lynbrook, N.Y. 11563

[21] Appl. No.: 874,389

[22] Filed: Apr. 27, 1992

[51] Int. Cl.[5] ..... A63H 27/00

[52] U.S. Cl. ..... 446/48; 273/425

[58] Field of Search ..... 446/36, 34, 46, 35, 446/37–45, 48; 273/425, 424, 426

[56] References Cited

U.S. PATENT DOCUMENTS

| | | | |
|---|---|---|---|
| D. 214,577 | 7/1969 | Mueller | 446/48 |
| 100,466 | 3/1870 | Goodwin | 446/46 |
| 3,082,572 | 3/1963 | Knox | 446/46 |
| 3,359,678 | 12/1967 | Headrick | 273/106 |
| 3,742,643 | 7/1973 | Keith | 446/36 |
| 3,955,817 | 5/1976 | Davis | 446/36 |
| 4,104,822 | 8/1978 | Rodgers | 46/74 |
| 4,132,029 | 1/1979 | Thompson et al. | 273/424 |
| 4,216,611 | 8/1980 | Psyras | 446/46 |
| 4,506,894 | 3/1985 | Laux | 273/425 |
| 5,030,157 | 7/1991 | Silvergate | 446/36 |

FOREIGN PATENT DOCUMENTS

| | | | |
|---|---|---|---|
| 467331 | 11/1952 | Italy | 446/46 |
| 529586 | 8/1957 | Italy | 446/36 |

*Primary Examiner*—Robert A. Hafer
*Assistant Examiner*—David J. Kenealy

[57] ABSTRACT

A rotating flying toy comprising a circular airfoil (12) and a plurality of radial airfoils (13). Said radial airfoils (13) extend, at a uniform angle, from a central hub (14), which is elevated in profile above the circular airfoil (12). When tossed through the air in different specific ways, the device performs various unique aerodynamic maneuvers involving its tendency to roll over in a predictable manner, during flight.

1 Claim, 3 Drawing Sheets

FLYING TOY WITH RADIAL AIRFOILS

BACKGROUND

1. Field of the Invention

Aerodynamic flying toys with circular, disc-like, or ringlike shapes are commonly utilized in games in which players toss them into the air, with a spinning motion, as a form of sport or recreation.

2. Description of Prior Art

The prior flying toys in the field, are capable of only a very limited range of aerial maneuvers and therefore offer the player very limited possibilities as to the manner of throwing motions that will produce a stable and predictable flight.

Disc-type toys, such as U.S. Pat. No. 3,359,678 to Headrick, are often unstable in slight and difficult to control. Lacking apertures through which the fingers can grasp, they are often difficult to catch. Their flight range is very limited in distance, due to excessive aerodynamic drag.

In U.S. Pat. No. 4,130,029 to Thompson et al., attempts were made to improve the aerodynamic performance of circular flying toys by attaching a many sided centrally located body to the circular base. This centrally located body provides a secondary gyroscopic action around the vertical axis, while acting as a centrally located airfoil to create lift by interrupting the airflow. However, the resulting extra weight limits the flight possibilities of the device.

Ring-type toys, such as U.S. Pat. No. 4,104,822 to Rodgers, offer generally improved stability in flight and, having an opening for the hand, are easy to catch, but, like the other prior flying toys, they provide only a very limited range of flight possibilities.

Until now, all attempts to improve the lateral stability of flying toys have resulted in a more limited range of aerial maneuvers, by limiting the tendency of flying toys to roll over in flight.

The primary object of prior flying toys is to achieve a stable, long range flight when tossed in a backhand manner, with a spinning motion. These flying toys were designed so that the device remains essentially parallel to the ground throughout the flight; none of these prior devices has the capability to perform extraordinary aerial maneuvers which incorporate the controlled and predictable use of rollover, when tossed in specific unusual ways. Therefore, the play value of such toys is limited to a narrow range which does not allow the players much variation or challenge.

OBJECTS AND ADVANTAGES

The present invention represents a significant advance in that it not only provides improved lift and stability, when thrown in the usual backhand manner, but can be also thrown in certain novel ways to perform various aerial maneuvers beyond the capability of previous flying toys.

The present invention allows the player to utilize the tendency of the device to roll over during flight in a predictable manner. When tossed upside down with a sidearm motion, the toy can be made to roll over in flight 180 degrees. When tossed vertically with an overhand motion, the toy can be made to roll over in flight 270 degrees. When tossed right-side-up with a sidearm motion, the toy can be made to roll over in flight 360 degrees. These unique aerial maneuvers, when incorporated into games, give the present invention much greater play value than prior flying toys.

A further object and advantage is to provide a toy with apertures through which the fingers can grasp, so as to allow it to be easily caught. An additional object and advantage is to provide a toy which is symmetrical, as to be thrown with equal results by either right-handed or left-handed players.

DESCRIPTION OF THE INVENTION

Figure 1:
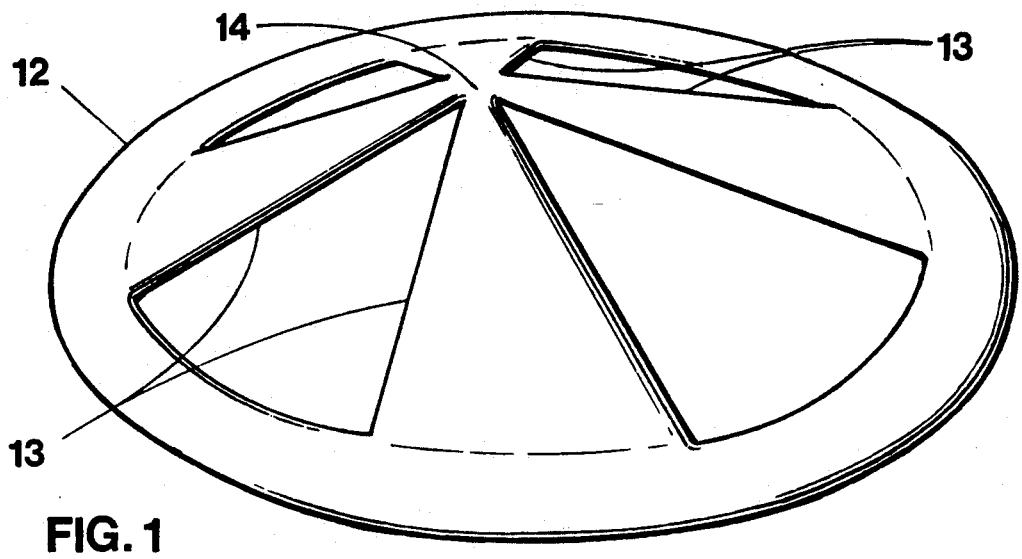
FIG. 1 shows the invention in perspective
Figure 2:
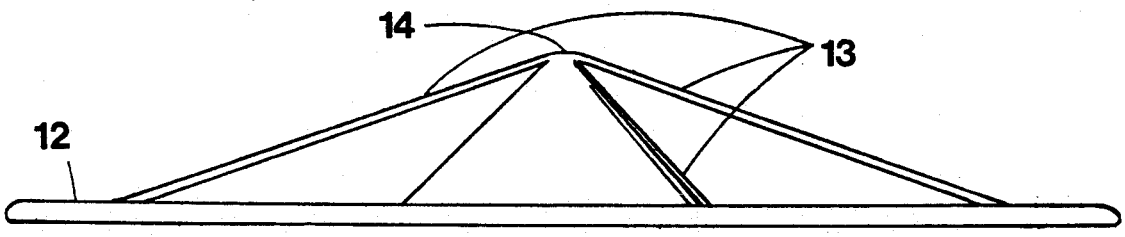
FIG. 2 shows a side view the invention

As seen in FIG. 1, the present invention comprises a plurality of tapered airfoils 13 radiating from a central hub 14 and joined to the inner edge of a circular airfoil 12. In the preferred embodiment, the said radial airfoils 13 are set at a uniform angle of 20 degrees, the highest point of elevational profile being at the central hub 14. The outline of the profile of the device, as shown in FIG. 2, defines an airfoil having maximum elevation at the central hub 14, while sloping to minimum elevation at the leading and trailing edges of the circular airfoil 12.

As air moves across the surface of said profile, during the flight of the toy, lift is provided in accordance with the principles of aerodynamics regarding airfoils. Lift is further provided by the rotating of the radial airfoils 13 about the central hub 14, as the toy spins in flight. A third source of lift is provided, as air moves across the surface of the circular airfoil 12, while the toy is in flight.

Figure 3:
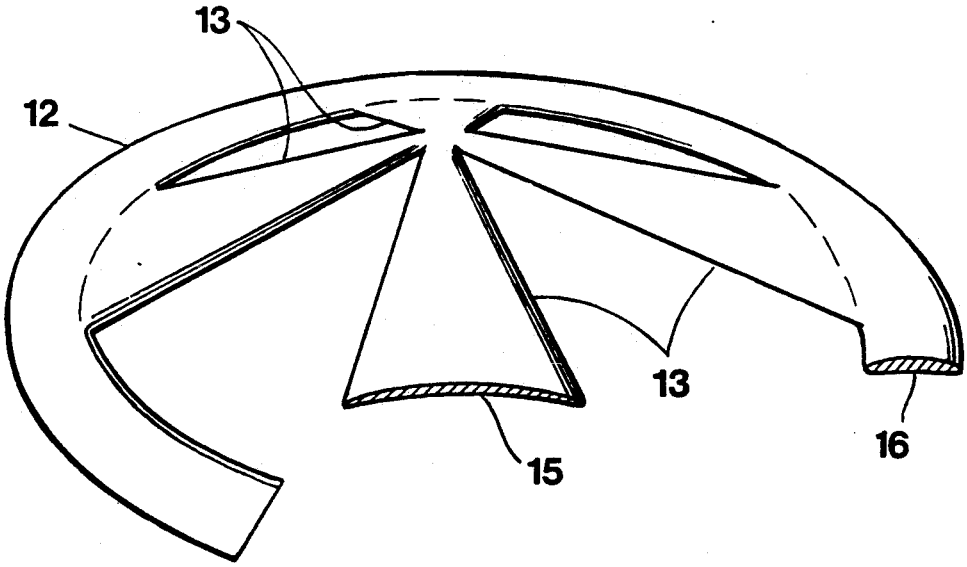
FIG. 3 shows the invention with cross-sections of a radial airfoil and the circular airfoil

FIG. 3 shows the cross-section 15 of the radial airfoil 13 is symmetrical, with the lower camber surface curving in the same direction as the upper camber surface. Also shown in FIG. 3, the cross-section 16 of the circular airfoil 12 is symmetrical with the curvature of the lower camber being in the same direction as the upper camber surface.

Figure 4:
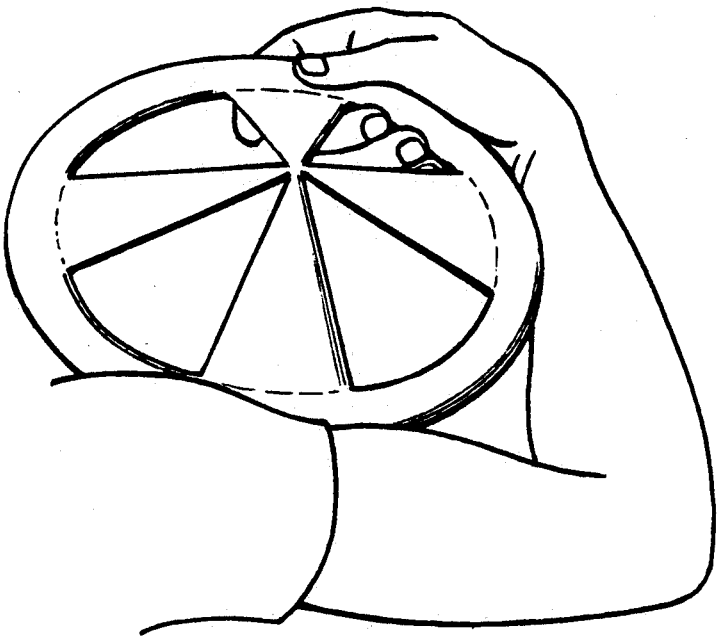
FIG. 4 shows the invention held in the backhand manner
Figure 5:
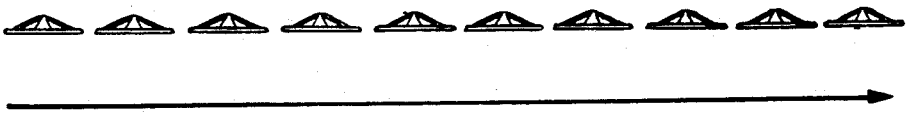
FIG. 5 shows the flight of the invention when it is thrown in the backhand manner

The combined action of the circular airfoil 12, radial airfoils 13, and profile of the device when the toy is thrown through the air, causes it to perform various unique aerial maneuvers, according to the manner in which it is thrown:

(a) Held in a backhand manner, as shown in FIG. 4, and released with a spinning motion, as gyroscopic flying toys are typically tossed, the device remains parallel to the ground in flight, as shown in FIG. 5. When thrown in this manner, the toy provides improved lift and lateral stability in flight.

Figure 6:
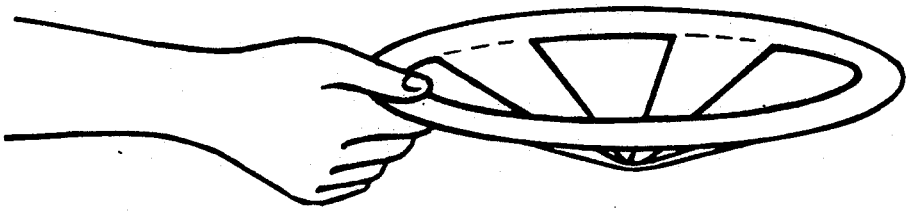
FIG. 6 shows the invention held in the inverted manner
Figure 7:
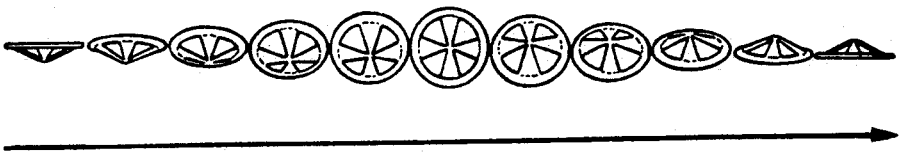
FIG. 7 shows the flight of the invention when it is thrown in the inverted manner

(b) Held upside down, as shown in FIG. 6, and tossed in a sidearm manner, without spin, the toy can be made to roll over 180 degrees in the flight, as shown in FIG. 7, whereupon it rights itself and starts to spin.

Figure 9:
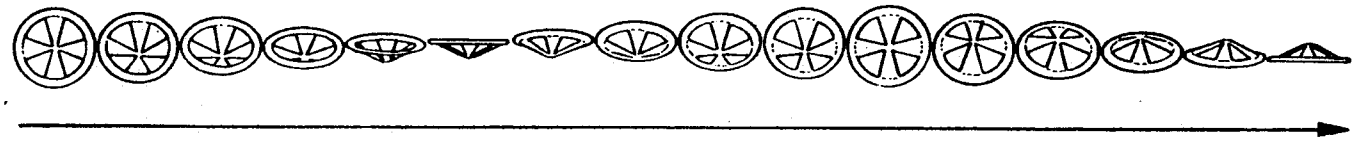
FIG. 9 shows the flight of the invention when it is thrown in the vertical manner
Figure 8:
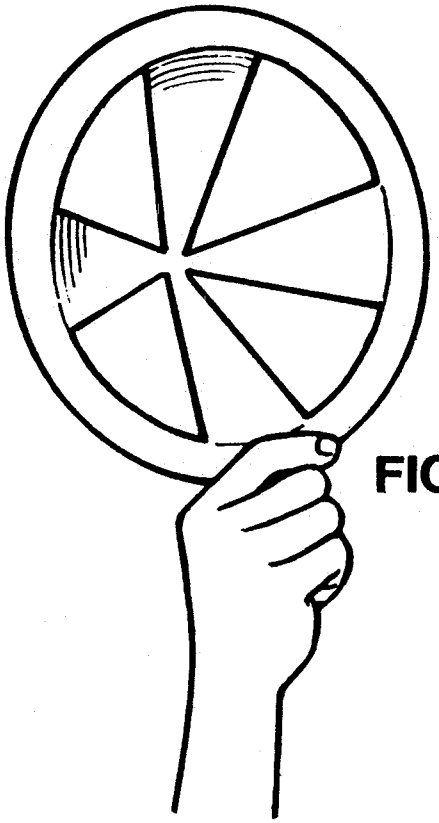
FIG. 8 shows the invention held in the vertical manner

(c) When held vertically, as shown in FIG. 8 and tossed in an overhand manner, with spin, the toy can be made to roll over 270 degrees, whereby it first rolls to an inverted position and continues rolling until it is right-side-up, as shown in FIG. 9

Figure 10:
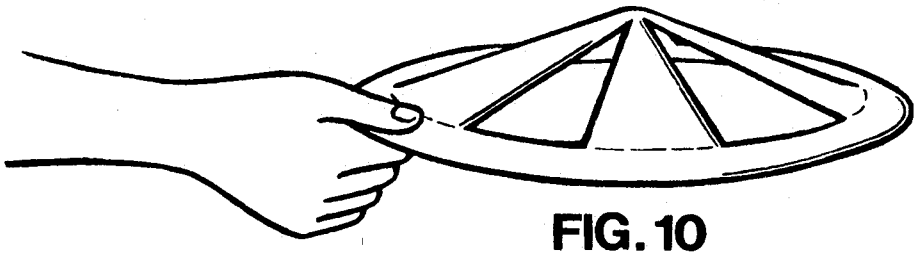
FIG. 10 shows the invention held right-side-up, in the sidearm manner
Figure 11:
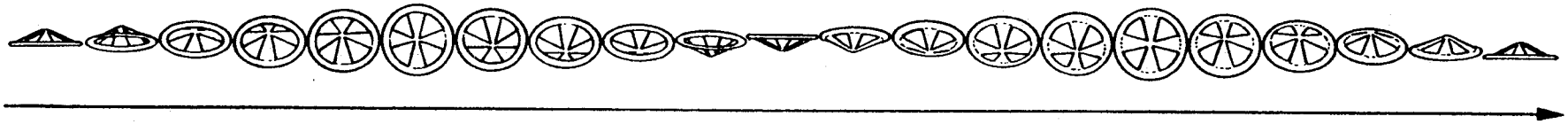
FIG. 11 shows the flight of the invention when it is thrown in the right-side-up sidearm manner

(d) When held right-side-up, as shown in FIG. 10 and thrown in a sidearm manner, without spin, the toy can be made to roll over 360 degrees, while acquiring a spinning motion in flight, as shown in FIG. 11.

(e) Other unusual feats can be performed, depending upon the skill and ingenuity of the player, providing a vastly expanded range of games which can be played.

SUMMARY, RAMIFICATIONS, AND SCOPE

The present invention is an improved version of an aerodynamic toy which spins as it flies in the air, tossed by a player. The toy includes a number of tapered airfoils radiating from a central point, which is elevated above a circular airfoil. Said radial airfoils connect at a uniform angle to the inner edge of the circular airfoil.

The present invention provides improved lift and stability, can be easily caught, and can be thrown with equal results by right-handed or left-handed players. The invention can be made to roll over in flight in various predictable ways, providing an expanded variety of flight patterns and throwing motions.

The specificities contained in the above description should not be construed as limitations on the scope of the invention, but rather as an exemplification of one preferred embodiment thereof. Many variations are possible.

For example, in the preferred embodiment, the lower camber surfaces of the radial airfoils and circular airfoil are curved in the same direction as the upper camber surfaces. Other embodiments may be contemplated in which the lower camber surfaces of the radial airfoils and circular airfoil have no curvature or do not have a symmetrical curvature.

Other embodiments of the present invention may be contemplated in which the radial airfoils may be more or less in number, may slope at a greater or lesser angle, and may taper more or less in width.

In the preferred embodiment, the edges of the circular airfoil are blunt enough provide safety and to allow the toy to be caught by a player in a comfortable manner. The total device may be of any dimension which may be tossed easily by a player. The device may be manufactured of any material which is lightweight enough to be tossed easily, while rigid enough to maintain its structural integrity.

I claim:

1. A circular aerodynamic amusement device, which can be made to fly in a level manner or made to roll over in flight in a predictable way, according to how it is tossed, comprising:

(a) a circular ring type airfoil which defines a plane having an upper surface and a lower surface and comprises means for causing the circular airfoil to lift in a direction perpendicular to the plane of the circular airfoil in the direction of the upper surface when the airfoil is passed through the air, the means for causing the airfoil to lift comprising a convex upper cambered surface and a concave lower surface generally parallel to the upper cambered surface;

(b) a plurality of radial airfoils equally spaced along an inner edge of the circular ring type airfoil and extending along a diameter of the circular airfoil from the inner edge of the circular airfoil at a continuous angle inclined with respect to the upper surface of the plane of the circular airfoil to a central hub located above the upper surface of the airfoil such that along a line perpendicular to the plane of the circular airfoil the upper surface is between the central hub and the lower surface, the radial airfoils having a width that tapers along their length to the central hub;

(c) the plurality of radial airfoils comprising means for causing the radial airfoils to lift in a direction perpendicular to the length of each of the radial airfoils when passed through the air, the means for causing the radial airfoils to lift comprising a convex upper cambered surface and a concave lower surface generally parallel to the radial airfoil's upper surface.

* * * * *